United States Patent [19]

Musil

[11] Patent Number: 5,002,398

[45] Date of Patent: Mar. 26, 1991

[54] APPARATUS FOR AND METHODS OF PRODUCING A HOT ASPHALTIC MATERIAL

[75] Inventor: Joseph E. Musil, Ely, Iowa

[73] Assignee: Cedarapids, Inc., Cedar Rapids, Iowa

[21] Appl. No.: 518,731

[22] Filed: May 3, 1990

Related U.S. Application Data

[62] Division of Ser. No. 367,343, Jun. 16, 1989, Pat. No. 4,946,283.

[51] Int. Cl.[5] ..... B28C 5/08; B01F 15/06

[52] U.S. Cl. ..... 366/7; 366/23; 366/25; 366/66; 366/147; 432/72

[58] Field of Search ..... 366/4, 7, 22, 23, 24, 366/25, 144, 145, 147, 148, 149; 432/14, 72, 73, 19, 105

[56] References Cited

U.S. PATENT DOCUMENTS

| | | | |
|---|---|---|---|
| Re. 29,496 | 0/1977 | Dydzyk . | |
| 4,309,113 | 1/1984 | Mendenhall | 366/25 |
| 4,318,619 | 0/1982 | Schlarmann . | |
| 4,332,478 | 0/1982 | Binz . | |
| 4,427,376 | 1/1984 | Etnyre | 366/25 |
| 4,481,039 | 0/1984 | Mendenhall . | |
| 4,519,711 | 5/1985 | Gillen | 366/4 |
| 4,600,379 | 0/1986 | Elliott . | |
| 4,616,934 | 10/1986 | Brock | 366/25 |
| 4,705,938 | 0/1988 | Hawkins . | |
| 4,813,784 | 0/1989 | Musil . | |

*Primary Examiner*—Robert W. Jenkins

*Attorney, Agent, or Firm*—Simmons, Perrine, Albright & Ellwood

[57] ABSTRACT

A continuous process aggregate drying and mixing plant for producing a hot asphaltic material, such as is used for paving highways or the like, includes a combination of a drum drier and a pugmill. Both the drum drier and the pugmill are supported by a common trailer frame. The pugmill is coextensively mounted at the discharge end of the drum drier towards the rear of the frame. The drum drier discharges dried and heated virgin aggregate material through a feed and transfer chute directly into a first, pre-mix region of the pugmill. The feed and transfer chute also provides for the addition of recycled pavement to the heated and dried aggregate and for the side discharge of such heated and dried aggregate. A second region of the pugmill within which liquid asphalt is added to the mixed aggregate is substantially separated from the first, pre-mix region. The space above the second region of the pugmill is substantially enclosed and coupled directly to a secondary air supply of a burner for the drum drier. Thus, vapors emanating from the second region of the pugmill are drawn into the burner and burned to form environmentally friendly products.

7 Claims, 2 Drawing Sheets

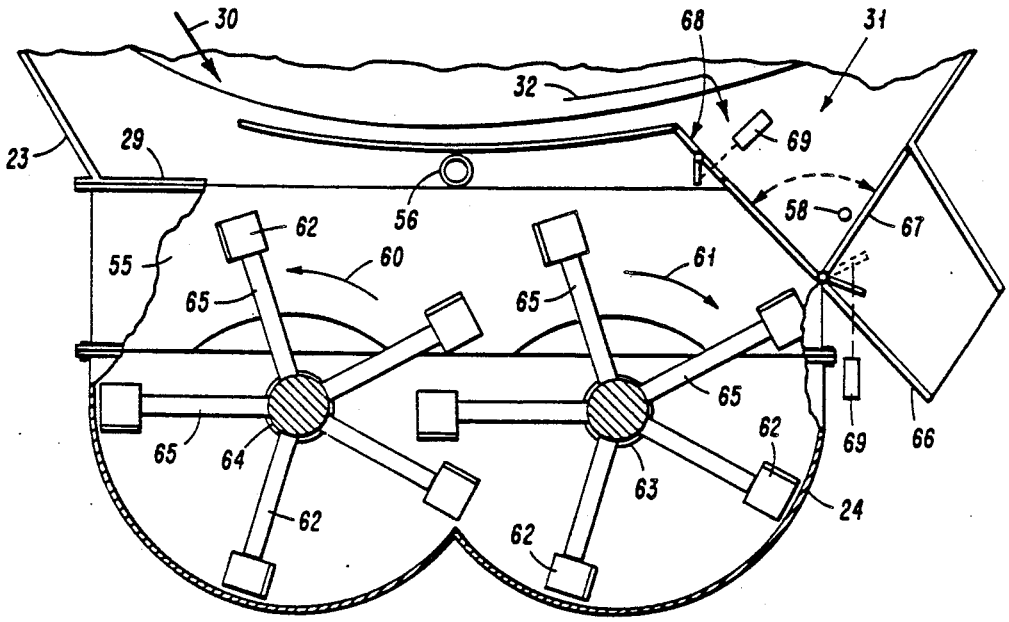
FIG 2
FIG 3
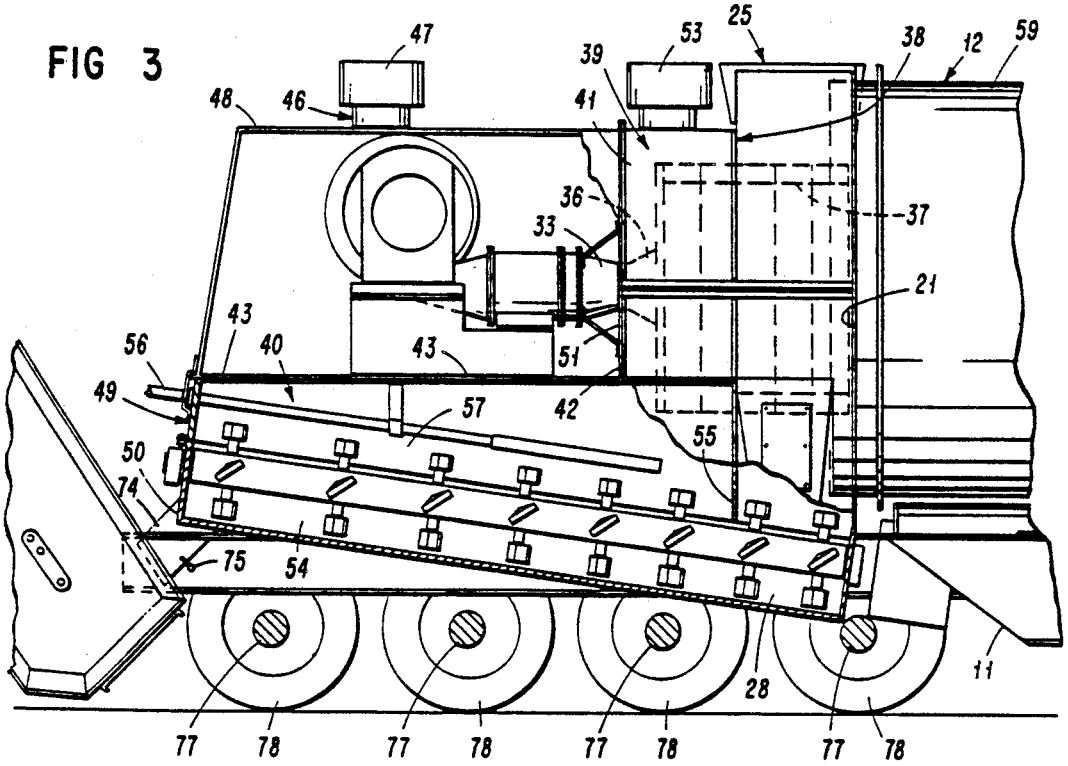

APPARATUS FOR AND METHODS OF PRODUCING A HOT ASPHALTIC MATERIAL

This is a division of copending application U.S. Ser. No. 07/367,343 filed on June 16, 1989 now U.S. Pat. No. 4,946,283.

BACKGROUND OF THE INVENTION

1. FIELD OF THE INVENTION

The invention relates to apparatus for and methods of producing a hot asphaltic material and also and particularly to apparatus for and methods of producing a hot asphaltic material by combining recycled asphaltic pavement with virgin aggregate.

2. DESCRIPTION OF RELATED ART

In accordance with current environmental protection efforts, demands are made on the highway construction and repair industry to use equipment which complies with environmental requirements. At the same time the equipment needs to be capable of producing quality highway paving materials in an efficient manner. In one approach to conservation and efficiency, recycled asphalt pavement ("RAP") is combined with virgin aggregate material ("VAM") and mixed with the addition of hot liquid asphalt cement. The mixing of the constituent materials typically takes place at elevated temperatures, and a propensity for problems appears to be present in that at a low temperature the asphalt cement thickens and hardens. Thus too low a temperature may not allow for adequate mixing of the constituents and higher temperatures can produce unwanted levels of smoke emissions from some types of RAP and asphalt binders as the asphaltic constituents begin to oxidize and to vaporize.

VAM, the virgin aggregate, is readily dried in a continuous drying process using drum driers. The driers feature large drums which rotate about axes disposed typically at a slight incline from the horizontal and which are typically equipped with an open flame burner and a blower at one end. The inside surfaces of such drums are further equipped with spaced sets of flights which lift the material and dump it in a falling curtain of the particulate material which exposes it to the hot gases emanating from the burner.

Asphaltic materials are produced in both continuous processes and in batch processes. In continuous mixing processes, drums such as those used for the described drum driers are used as mixing drums, of course with proper modifications for (he addition of other materials and the asphalt cement. Continuous processes, while having been used with some variations, typically need to deal with the volatility of the asphalt materials. RAP, the recycled material, tends to smoke when subjected to open flames or excessive heat. RAP can, however, be introduced into less hot regions of drying and mixing drums. According to a known procedure, the VAM is superheated to temperatures well above a desirable temperature range for the final asphaltic product. The ultimate mixture then yields an acceptable average temperature after the addition of the relatively cooler RAP. Yet, the addition of asphalt cement in contact with the still superheated VAM can also lead to the generation of unwanted "blue" smoke, an organic asphalt gas which is undesirable from an environmental standpoint.

According to one prior art apparatus for mixing VAM and asphalt cement the disclosed structure divides the drum into a drying section and into a mixing section. A burner feeds hot gases directly into the drying section of the drum, while the mixing section is partially shielded from the direct contact with the flame of the burner. The apparatus also provides a looped gas return which permits some gas from the mixing chamber to be fed via a return duct to the burner. The prior art apparatus nevertheless provides for gas to be released from the mixing chamber to the atmosphere. In a steady state operation, such release would also occur continuously, as hot gases are continuously being generated by the burner.

In another continuous process, instead of using drums for mixing, another type of apparatus known as a "pugmill" is used. The constituents of the mix are fed into storage hoppers, and are continuously dispensed in specified proportions into a drier. The preheated virgin aggregates may be superheated and are usable in such a system for some preheating of RAP to occur by heat transfer from the VAM with an associated cooling of the superheated VAM. The liquid asphalt cement is then added directly to the dry mix within the pugmill. The output from the pugmill can then be discharged directly into a truck for immediate use on a paving job. In the alternative, the output from the pugmill may be transferred to a silo from where it would be loaded into trucks to be carried to a job site.

When pugmills are used in continuous mixing operations, the materials are sometimes dry-mixed at one end of the pugmill and are thereafter coated with the liquid asphalt cement and wet-mixed in a down-stream portion of the pugmill before being discharged at the other end of the pugmill.

In a prior art batch-type mixing operation which used both VAM and RAP as constituents for the asphaltic material, the VAM was superheated, approximately to a temperature of 500 degrees Fahrenheit, and transferred to a weigh hopper to be dispensed in batches into the pugmill for final mixing and discharge into trucks. The RAP was metered in desirable proportions into the weigh hopper to become intermixed with the VAM or portions thereof in the weigh hopper.

One of the disadvantages of the described system is an inability to control the temperatures of the mix. Another disadvantage is the heat loss from the stored aggregate, which in turn is translated to inefficiency and to an inability to tightly control temperatures of the final mix. The final product may consequently experience the symptoms discussed above that are observed when mixing occurs at a temperature which is either too low or too high.

Another known disadvantage of prior art systems is what is known as a venting problem that occurs when comparatively cool RAP is combined suddenly with super-heated VAM, as the aggregates drop out of a weigh hopper into a pugmill. Since the Rap frequently contains a significant amount moisture, a rapid generation of steam has frequently caused such a venting problem. The generated steam is not readily vented and generates momentarily high pressures, causing reactions similar to small explosions.

The known prior art also does not provide for an efficient apparatus and method in which a pugmill mixes specified portions of RAP and VAM in a continuous mixing process, and particularly not one in which such apparatus has the compactness to permit ready portability as is desirable for many highway construction projects.

SUMMARY OF THE INVENTION

According to one broad aspect of the invention, apparatus for producing hot asphaltic material includes an elongate, substantially horizontally disposed drum the interior of which is heated by a burner for drying aggregate material fed into the drum. The burner uses air from primary and secondary air sources for generating hot gases which are routed through the drum to heat and dry the aggregate within the drum. A pugmill is located adjacent a discharge end of the drum. A chamber above a mixing region of the pugmill is communicatively coupled to, and forms part of, the secondary air source such that gases from such mixing region of the pugmill are combined with air drawn into the burner and are subjected to the combustion process. A method according to the invention includes supplying air to a burner for drying aggregate material to be mixed with asphalt in a pugmill, and drawing gases from a chamber of the pugmill wherein the aggregate becomes mixed with the asphalt into a secondary air supply of the burner, whereby organic components of the gases in the chamber above the pugmill are subjected to the flame of the burner.

In another aspect of the invention a discharge of heated aggregate from the drum is combined with recycled asphalt pavement material in a first region of a pugmill, wherein the recycled asphalt pavement material is dried, such first region being communicatively coupled with the drum for drying the aggregate and steam generated as a result of the drying of the recycled pavement material is drawn into the drum, such first region being separated by a baffle plate from a second region of the pugmill wherein hot asphalt is added to the combination of the aggregate and recycled asphalt material, such second region of the pugmill being communicatively coupled to an air source of a burner, such that gases generated within the second region are subjected to the flame of the burner to pyrolytically cleanse such gases.

The various features and advantages of the invention will be best understood by the following detailed description of a preferred embodiment of the invention, when read in reference to the appended drawings.

BRIEF DESCRIPTION OF THE DRAWINGS

FIG. 2 is a cross section of a pugmill of the apparatus shown in FIG. 1; and

FIG. 3 is a partial view on a larger scale of the discharge end of the apparatus shown in FIG. 1, depicting in greater detail the relative location of some elements of the apparatus.

DETAILED DESCRIPTION OF THE INVENTION

Figure 1:
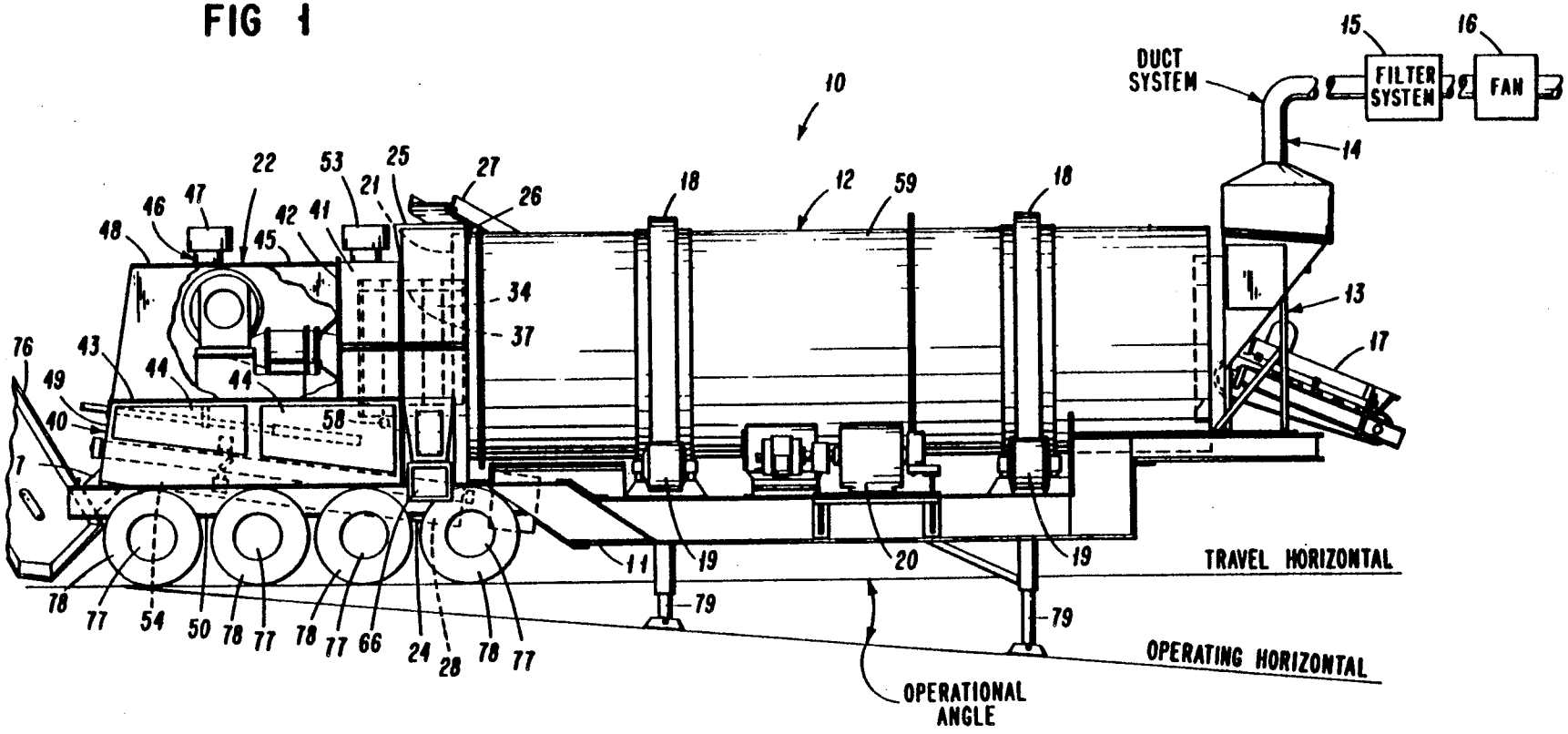
FIG. 1 is a side elevation of an apparatus for making asphaltic materials, the depicted apparatus incorporating the features of the present invention.

Referring to FIG. 1, there is shown an overall view of a portable mixing and recycling plant, a piece of equipment which is generally referred to herein as apparatus 10, the apparatus 10 incorporating the features of the present invention. Various major elements or components are either structurally mounted to or supported by an elongate, wheeled frame 11, thus imparting portability to the apparatus 10 in that the apparatus 10 may be towed over highways between job sites.

A component of major size of the apparatus 10 is a drum drier 12. The drum drier 12 is rotatably mounted to the frame 11 and is disposed longitudinally in parallel with the longitudinal extent of the frame 11. At a first end on the right of the drum drier 12, as viewed in FIG. 1, is a feed or intake port 13, for feeding a first type of aggregate material, a crushed rock or stone material, also referred to as Virgin Aggregate Material or VAM into the drum drier 12. A duct system 14, schematically shown in FIG. 1, typically communicates with a filter system 15, for example, one that is commonly known as a baghouse filter. Air is exhausted from the entire installation including the drum drier 12 and other portions of the apparatus 10, as further described herein, through the duct system 14 powered by an exhaust fan 16. In the apparatus 10, the exhaust fan 16 is located in communication with the intake end 13 of the drum drier 12. It is to be understood that a number of alternate systems, simple or complex, may be installed, all of which can be referred to as an exhaust system or means for exhausting gases from the dryer. A short "slinger" conveyor 17 is used to feed the VAM into the intake port 13 of the drum drier 12. The drum drier 12 is rotatably supported by peripheral steel tires 18 which rest on trunnions 19 mounted to the frame 11 and driven in a manner typical for drum driers. A preferred drive 20 for the drum drier 12 is one which is commercially known as sprocket and saddle chain or cradle chain drive.

The drum drier 12 shown in FIG. 1 is of a type known as a "counterflow" drier Thus while the material to be dried will advance through the drum drier 12 from the intake port 13 to a discharge end 21 on a second or left end of the drum drier 12 as viewed in FIG. 1, hot gases generated by a burner assembly or burner unit 22 are injected into the discharge end 21 of the drum drier 12 and flow through the drum drier 12 against the direction of material advance therethrough towards the duct system 14. The duct system, to the extent that it communicates with the exhaust fan 16, will tend to lower the pressure within the drum drier 12 at least by some determinable amount below that of the ambient pressure. The reduced pressure in the drum drier 12 may be regarded advantageous in operations in which the type of aggregate generates excessive amounts of dust. The reduced pressure is also advantageous for the overall function of handling hot gases and the respective air supplies for optimum drying action while at the same time minimizing air pollution by dust products of the operation. The duct system 14, as well as the drum drier 12 are under suction, hence at a pressure less than the ambient atmospheric pressure, drawing gases from the drum drier 12. Also, it should be understood that the duct system 14 may include or be connected to any of a number of available filters or dust collectors or emission control devices. The exhaust fan 16 is typically located downstream from the filter 15, to protect it from debris which will be retained by the filter 15.

At the discharge end 21 of the drum drier 12, an annular feed and transfer chute 23 directs the VAM expelled from the drum drier 12 into a pugmill 24 which is located below the burner unit 22. The feed and transfer chute 23 performs multiple functions in that it also has a feed hopper 25 mounted at its upper end 26 for receiving aggregate material directly as an additional input and not as a discharge from the drum drier 12. In a particular mode of operation of the apparatus 10, a second type material referred to as Recycled Asphalt pavement or RAP is fed via a feeder, such as a RAP conveyor 27 into the feed hopper 25. It should be understood, that the second type material could be material other than RAP, and could even be an additional quantity of VAM, possibly of a different consistency, or a mixture of RAP and VAM.

FIG. 2 shows a cross section of the pugmill 24 as viewed from the left side of the apparatus 10 in FIG. 1 The second type material or RAP falls by gravity through the feed and transfer chute 23 into an intake end or first region 28 (see FIG. 1) of the pugmill 24, and particularly into a first laterally offset portion 29 of such first region 28 as shown by the arrow 30 The discharge of VAM from the drum drier 12 enters by gravity through the feed and transfer chute 23 into a second, oppositely located laterally offset portion 31 of the first region of the pugmill 24 as indicated by arrow 32. It is in such first region of the pugmill 24 that the RAP and VAM are combined with the aid of mixing action of the pugmill 24.

The burner unit 22, its elements and their relationships to the pugmill 24 should be considered in reference to FIG. 3. The burner unit 22 includes a burner 33 and a cylindrical combustion chamber 34, both of which are supported by the frame 11. The combustion chamber 34 may be any one of a number of different types of chambers, and the chamber structure disclosed herein is one particular example of a combustion chamber. Thus, the chamber 34, by choice may be of different length or may or may not have refractory lining. The burner 33 is preferably of a type driven by a turbo blower unit 35 which serves as a primary supply or primary source of air supplied to a flame holder such as a burner nozzle 36. The burner nozzle is coupled to a typical fuel supply (not shown), which in essence is a regulated supply line coupled to the nozzle 36. The burner 33 is preferably adaptable to burn fuel oil, natural gas or other typically available fuels such as Lp gas or coal. Fuel supply provisions for such burners are known in the art and are consequently not further elaborated on herein. The hot gases generated by the flame of the burner nozzle 36 exit from the nozzle 36 with force. The force is the result of air flow generated by the primary air supply, namely the turbo blower unit 35. The plume of the flame and the resulting hot gases are directed by the orientation of the burner nozzle 36 into the combustion chamber 34 and toward the drum drier 12.

The combustion chamber 34 is mounted in coaxial disposition with the burner nozzle 36, the chamber is consequently exposed on its inner cylindrical wall to the heat from the plume of the flame generated by the burner nozzle 36. The interior surfaces of a peripheral wall 37 of the combustion chamber 34 may be lined with typical fire resistant materials such as fire brick or may be fabricated of stainless steel. Thus on the one end the wall 37 forms an annular opening between itself and the burner nozzle 36. The other end of the cylindrical wall 37 is also centrally disposed with respect to the drum drier 12, forming circular opening toward and centered on a longitudinal center through the drum drier 12. The exterior of the wall 37 abuts and is supported by a vertically oriented support structure 38 which in essence represents one wall 38 of a secondary air chamber 39. The vertical support structure 38 closes off what would otherwise be an opening communicating directly between such chamber 39 and the drum drier 12.

The chamber 39 is a space defined and enclosed by the vertical support structure or wall 38 closing off the chamber 39 toward the drum drier 12, by the pugmill 24, by a pugmill enclosure 40, and by an upper chamber hood 41. Also in reference to FIG. 1, a rear wall 42 of the upper chamber hood 41 seals the chamber 39 ±rom the turbo blower unit 35. A top plate 43 of the enclosure 40 closes off the space above the pugmill 24 toward the burner 33 and functions as a support base for the burner 33. Side panels 44 of the enclosure 40 provide access to the pugmill 24, are, however, contemplated to remain in place during the operation of the apparatus 10.

A burner hood 45 encloses the burner unit 22, particularly the turbo blower unit 35 which forceably supplies primary air to the burner nozzle 36. The hood is intended to remain closed during the operation of the apparatus 10. The hood provides a significant reduction in operating noise which is typically generated by the turbo blower unit 35 and the burner nozzle 36. For example, a sound level of about 100 db is attenuated by approximately 10 db by the burner hood 45. The burner hood 45 closes against the top plate 43 and the rear wall 42 of the upper chamber hood 41. Primary air has access to enter the sound enclosure provided by the burner hood 45 through a separate air intake assembly 46 including preferably three mufflers 47 mounted in a top surface 48 of the burner hood 45. The air intake assembly 46 couples the mufflers 47 directly into the primary air path to the turbo blower unit 35, independent from air intakes for secondary air requirements.

An environmentally correct and efficient operation of the burner 33 depends on the correct amount of primary and secondary air supplied to the burner 33. The primary air establishes the initial, though possibly fuel rich, combustion mixture for the flame in the burner 33. The secondary air supply serves to lean out the initially rich but steady flame by providing additional air for the complete combustion of the fuel. The total air supplied to the flame includes the stoichiometric air, namely that amount of air relative to the fuel supplied to the burner 33 which in theory would be sufficient for complete combustion of such fuel, and an amount of excess air found necessary to assure actual complete combustion.

The burner hood 45 is pivotally attached at its base to a discharge end 49 of the apparatus 10 to swing upwardly open and provide access to the burner 33. However, during the operation of the apparatus 10, as contemplated, the burner hood 45 is to remain closed.

The pugmill 24 is disposed longitudinally between spaced rear beams 50 of the frame 11, in proximity to and below the burner 33 and the combustion chamber 34. FIG. 3 shows the previously described structures partially removed or in section to permit a better illustration of internal structural elements and their functional cooperation. The wall 37 defines an annular opening 51 in a space between itself and the burner nozzle 36 This annular opening communicatively couples the combustion chamber 34 with the chamber 39 through which secondary air is supplied to the combustion chamber 34. The secondary air supply, as described above, serves to provide stoichiometric and excess air for complete combustion of fuel in the combustion process. As shown in FIG. 1, a top panel of the upper chamber hood 41 carries hooded air intake openings 53 through which secondary air enters the chamber 39 from the environment. The amount of secondary air drawn through such openings 53 depends of course on a pressure differential within the chamber 39 and the environment.

The pressure within the chamber 39 decreases as air or gases are drawn through the annular opening 51 into the combustion chamber 34. A venturi effect caused by the forced flow of the combustion gases emanating from the burner nozzle 36 generates a certain gas flow through the opening 51. The flow is further increased or decreased by exhaust gases drawn from the apparatus 10 and exhausted through the duct system 14.

The first region 28 of the pugmill 24 is separated from a second, rear region 54 of the pugmill 24 by a baffle plate 55 which is mounted to, and is part of and an extension of the vertical support structure and wall 38 downwards toward the pugmill 24. The baffle plate 55 extends downward, close to the working level of aggregate in the pugmill 24, leaving little room for gases to escape past the baffle plate 55. As a preferred embodiment, the baffle plate 55 is adjustable upward and downward to minimize open space between the first and second regions of the pugmill 24. The baffle plate 55 thereby excludes the first region of the pugmill 24 from functionally being part of the chamber 39. Also, to the extent that the vertical support structure 38 closes off and eliminates otherwise direct communication to the discharge end 21 of the drum drier 12, the first region 28 of the pugmill 24 being disposed on the drum drier side of the vertical support structure 38 remains in direct communication with the drum drier 12.

The second region 54 of the pugmill 24 is removed from such direct communication with the drum drier 12, its communicative passage to the drum drier 12 leading instead through the combustion chamber 34. A source of hot, liquid asphalt cement, also referred to as Asphalt Cement or A/C, the source being a spray bar or supply pipe 56 extends from the rear longitudinally into the chamber 39 and terminates in a space 57 in the second region 54 of the pugmill 24. A discharge location of the asphaltic cement within the second region 54 is one of choice and preference. The discharge location of the asphaltic cement from the supply pipe 56 is, consequently, adjustable. The asphaltic cement or liquid asphalt is consequently introduced into the second region 54 of the pugmill 24. The pugmill 24 and its separation into first and second regions 28 and 54, respectively, bring to mind an embodiment in which each of the regions are separate pugmills operating in unison to achieve the desired result. The combination of two such pugmills arranged in the described manner is considered to be a logical change within the scope of this invention.

A control of the temperature of the VAM on a continuing basis as it is discharged at the discharge end 21 of the drum drier 12 is considered important to successfully mixing the VAM with the RAP as well as the mixture of the two with the asphaltic cement.

Preferably a bi-metal thermocouple 58, known in the art as a temperature sensing transducer, is located at the discharge end 21 of the drum drier 12 in the transfer chute 23. The thermocouple 58 functions to produce an electric potential between two dissimilar metals, the magnitude of the potential having a known relationship to the temperature of the metal transducer. Thus when the apparatus 10 is set up for operation at a work site, the thermocouple is typically connected to a readout in an operator's control room (not shown) to provide a continuous monitoring of the temperature of the VAM being discharged from the drum drier 12. It is further possible to use signal inputs representing temperature readings from the thermocouple 58 to control fuel flow to the burner unit 22. It is thereby possible to automatically control the temperature of the VAM as it exits from the drum drier 12. Such monitoring or control is deemed desirable if not necessary for maintaining desirable consistencies of the asphaltic product. Temperature sensors other than the preferred thermocouple 58 are known in the art and may be used in lieu of the thermocouple 58 without departing from the scope of this invention. Such other sensors include, for example, infra-red heat sensor probes. Such heater probes provide a non-contact means of measuring the temperature of the VAM being discharged from the drum drier 12.

MODE OF OPERATION OF THE INVENTION

In operating the apparatus 10 VAM is introduced into the drum drier 12 by feeding it via the slinger conveyor 17 or through other desirable feeder provisions. The drum drier 12 functions in a known manner, the burner unit 22 supplying hot gases to the inside of the drum drier 12 to dry and heat the VAM advancing through the length of its drum 59. A counterflow of the hot gases allows the lower temperature of the drying gases to be used for drying the VAM as it is first introduced into the drum and allows relatively hotter zones of the drum 59 to be used to superheat the material after it has been dried.

The VAM is preferably heated to a temperature in a range about 550 degrees Fahrenheit, though higher temperatures are possible. The temperature of 550 degrees F. is already well above the vapor point of asphaltic cement which are typically used in the production of asphaltic materials. The temperature of 550 degrees Fahrenheit is a preferred temperature within an acceptable range of temperatures. Changing the temperature to which the VAM is heated is possible and may become necessary as will become apparent. One of the uses of the superheated VAM is the drying and preheating of RAP as the RAP is mixed with the VAM. Consequently, it is seen that, for example and not to the exclusion of other possible factors, the proportion of the RAP to the VAM, the temperature of the RAP, or the moisture content of the RAP would play roles in the amount of thermal energy needed to be supplied to the RAP to consistently produce a quality asphaltic material. Another factor for adjusting the temperature of the VAM might be the asphaltic contents of the RAP. Thus a temperature for the VAM could range between 300 and 850 degrees Fahrenheit.

A particular feature of the preferred embodiment of the invention is the direct discharge of the VAM from the discharge end 21 through the feed and transfer chute 23 into the first region 28 of the pugmill 24. At this stage the VAM has just passed the hottest zone of the drum drier 12 adjacent the end at which the hot gases from the burner unit 22 are introduced. It is possible to control the temperature of the VAM closely at this point. In addition to the thermocouple sensor 58, infra-red temperature sensors are known, for example, for contactless temperature measurements of materials. An advantage of the disclosed apparatus 10 is to have provided the capability to achieve mixing of the RAP and the VAM immediately after the VAM is discharged from the drum 59. This allows the desired amount of heat energy to be stored in the VAM, and then to transfer that desired amount of heat to produce the hot asphaltic material.

In reference to FIG. 2, arrows 60 and 61 indicate the rotation of paddles 62 mounted to the cooperating, counter-rotating shafts 63 and 64. The shafts include radial extension arms 65, to the ends of each one of the paddles 62 are mounted. As is well known in the art pertaining to pugmills, the paddles are mounted at a rake angle to the axial direction of the shafts 63 and 64. The rake angle determines the direction into which material will be urged or pushed while it is being mixed through the action of the paddles 62 as the shafts 63 and 64 counter-rotate in synchronous rotation. The axial extent of the shafts is essentially coextensive of the axial extension of the drum drier 12, namely in the longitudinal direction of the frame 11. Except in the preferred embodiment the pugmill 24 is mounted within the frame 11 to slope upwards as is further discussed below with respect to the overall operation of the apparatus 10.

RAP having been fed into the feed and transfer chute 23 in the described manner drops into the laterally opposite portion of the first region 28 of the pugmill. Typically the RAP would be fed at ambient temperatures, or approximately 70 degrees Fahrenheit, taking an average temperature as an example. Thus, the relatively cold RAP is brought into contact with the superheated VAM in such first region 28 of the pugmill 24 for an initial dry mixing cycle. The dry mixing cycle transfers heat from the VAM to the RAP. Frequently the RAP contains significant amounts of moisture. Thus, as the RAP is heated, the moisture is driven off and is drawn directly into the drum 59 of the drum drier 12. As the RAP is heated, the VAM, on an average, cools to a lower temperature in preparation for the addition of the liquid asphalt in the second region 54 of the pugmill 24. As discussed above, the temperature of the RAP and its moisture contents may be taken into consideration in determining the temperature to which the VAM is to be heated.

As the mixture of the RAP and VAM advances as a result of the action of the paddles 62 to the second region 54 of the pugmill 24, the mixture of RAP and VAM is coated with the liquid asphalt. The liquid asphalt, which itself is at a temperature close to its vaporization temperature, is likely to come into contact with portions of the initially superheated VAM which have not cooled sufficiently to prevent some of the liquid asphalt from becoming vaporized. The vapor of the asphalt is an organic hydrocarbon gas which is considered undesirable from an environmental standpoint. It is therefore desirable to eliminate the asphalt vapor in an efficient manner. The vapor, because of the location of the second region of the pugmill 24 at the base of the chamber 39, escapes directly into, and becomes part of, the secondary air destined to be drawn from the chamber 39 into the combustion chamber 34 of the burner unit 22.

The division of the pugmill into first and second separate regions shields the asphalt vapor from being drawn directly into the drum drier 12. Thus the vapor is essentially prevented from escaping without passing the plume of the flame emitted from the burner nozzle 36. At the same time the division of the pugmill into first and second regions substantially prevents the steam generated during the drying cycle of the RAP from diluting the secondary air source with steam, thereby permitting any asphalt vapors generated to be drawn in a relatively more concentrated manner into the combustion chamber 34. The temperatures of the combustion process to which the asphalt vapors are subjected in the combustion chamber 34 are sufficient to burn the asphalt vapor. The resulting combustion products are carbon dioxide and water, neither being considered toxic or undesirable, such that the burner flame tends to eliminate by combustion undesirable hydrocarbon components to prevent them from being exhausted into or through the duct system 14.

Referring again to FIG. 1, the preferred embodiment includes further other features advantageous to the operation of the pugmill 24 and the apparatus 10 in general. For example, a side discharge chute 66 is shown to extend from the lower portion of the feed and transfer chute 23. The chute 66 is typically closed, such that all of the VAM discharged from the drum 59 is directed into the pugmill 24 as described. It is, however, possible to automatically open a cover door 67 and move a deflector plate 68 inside the cover door 67 of the chute 66 to divert all or a portion of the VAM discharged from the drum 59 to be discharged from the apparatus 10 and not enter the pugmill 24. The automatic operation may be facilitated by typical pivots and actuators such as an actuator 69. This option would typically be used to permit the drum drier 12 to provide material for a conventional batch operation, as referred to in the background discussion of the invention.

It is also possible, and may be feasible with the addition of certain apparatus, to discharge only some but not all of the dried and heated VAM through the discharge chute 66 and direct the remainder of the VAM to the pugmill 24 to be mixed in the manner described. If such a division of the heated VAM is desired, a side conveyor (not shown), which may be used to receive any portion including all of the VAM being discharged from the drum drier 12, includes what is known in the art as a weigh cell. Such a weigh cell is used to weigh the material supported at any given time on a predetermined length of a conveyor belt. When the weigh cell is properly calibrated, and the speed of the conveyor belt is known, the rate at which material is removed through the discharge chute 66 will then be known. It is then contemplated to increase by a like rate the feed of the RAP into the feed hopper 25. Such measuring and transfer techniques would allow, for example, the proportions of VAM and RAP to be altered without altering the overall output of the apparatus 10.

The mixed product of hot asphaltic material is subsequently discharged from a discharge chute 74 of the pugmill 24, as shown in FIG. 1. It is desirable to monitor and control the temperature of the final product and to change the temperature of the VAM if necessary. A thermocouple 75 is, consequently, inserted into the discharge chute 74 to measure the temperature of the final asphaltic product as it is discharged from the apparatus 10. Preferably, the product is discharged from the discharge chute 74 into a "hot mix elevator 76". The hot mix elevator 76 carries the product to a typical, raised storage bin or silo (not shown), from where the product may be dispensed downwards into trucks to be hauled to a job site such as a paving project.

Also in reference to FIG. 1, the pugmill 24, being typically constructed of heavy gage steel and cast iron components and comprising a major portion of the weight of the apparatus 10, is mounted over quadruple axles 77 mounted at the rear of the frame 11, each axle supporting four tires 78. This provides an advantageous weight distribution for highway transport and accessibility to job sites. The relatively lighter, though larger, drum drier 12 has its weight distributed substantially equally between the axles 77 at the rear of the frame 11 and what would be a front support for the frame 11, such as during movement a typical semi-tractor, which is not shown.

The drum drier 12 is mounted in parallel with respect to the frame 11, and the frame being essentially horizontal, the drum drier 12 is therefore horizontally disposed. The pugmill 24 is preferably mounted between parallel beams of the frame 11 sloping upward toward the rear, namely, the discharge chute 65, at an angle of eight degrees. However, when the apparatus 10 is set up at a job site to a preferred working slope for optimum operation, the frame 11 is raised at its front end, elevating the feed port 13 of the drum drier 12 and positioning the drum at a downward slope of ideally 4.75 degrees in the direction of material flow through the drum 59. At this angle, even though the drum 59 can still be considered to be substantially horizontal, gravity will play a partial role in moving the VAM through the drum 59. The frame will be supported at this operational angle by typical jacks 79.

Raising the frame 11 as described also decreases the angle at which the pugmill 24 is sloped upward toward its discharge chute 65. The pugmill 24 will desirably operate at an upward or positive slope of nominally 3.25 degrees. Because of the downward and inwardly directed mixing action of the dual shafts 63 and 64 of the pugmill, it is possible to mount the paddles 62 to the extension arms 65 of the shafts 63 and 64 at such angles that the mixing action pushes the material upward against what is considered a shallow slope, in which case gravity works slightly against the paddles 62. It is believed that this gravitational resistance to the desired direction of advance of the material through the pugmill 24 contributes to achieve an optimum mixing of aggregate material constituents.

The flow-through capacities of the drum drier 12 and the pugmill 24 are established according to known factors relating, respectively, to drum driers and pugmills. Flow-through capacities of drum driers vary according to drum diameters, drum rotational speeds and the angle and type of flights attached to interior surfaces of the drums. Similarly, flow-through capacities of pugmills may vary as a function of the size of the pugmill, the S operational speed, the size and the number of paddles and also the angles at which the paddles are mounted with respect to the axes of the shafts of the pugmills. In addition, the flow-through of the drum drier 12 may need to be varied, depending on the type of VAM to be dried and on the moisture content. It may therefore become necessary to increase or decrease slightly the time period during which the VAM material remains in the drum drier 12 before it is discharged into the feed and transfer chute 23.

The flow-through of both the drum drier 12 and the pugmill 24 can be altered by the angle at which the drum drier 12 and the pugmill 24 operate, all other parameters being equal. In changing the angle with respect to a horizontal plane of either one, gravity will respectively increase or decrease the flow-through of material depending on whether the angle has become steeper of more shallow. It is therefore a further advantage of the apparatus 10 that the drum drier 12 and the pugmill 24 are coextensively mounted onto the common frame 11. Both the drum drier 12 and the pugmill 24 are during their operation advancing material in the same direction. Hence, a change in the operational angle with respect to the horizontal of the apparatus 10 affects both the drum drier and the pugmill substantially equally. Thus, if the flow-through of the drum drier 12 is increased by changing its working angle, the flow-through of the pugmill 24 is also changed by a substantially equal amount.

While the foregoing invention has been described in terms of a specific, preferred embodiment thereof it is to be understood that various changes and modifications can be made in any of a number of ways in the described embodiment without departing from the spirit and scope of the invention. This invention is to be defined and limited only by the scope of the claims appended hereto.

What is claimed is:

1. A method of producing a hot asphaltic material, comprising:

heating a first aggregate material to a first elevated temperature above a vaporization temperature of an asphaltic cement to be combined with at least a portion of said first aggregate for producing said hot asphaltic material;

cooling at least a portion of the first aggregate material to a second temperature lower than said first elevated temperature;

combining said portion of said first aggregate with an asphaltic cement, whereby selected components of said portion may be above the vaporization temperature of the asphaltic cement, thereby vaporizing a portion of the oil; and drawing said vaporized portion of the oil into a burner flame for heating said first aggregate material to burn the asphaltic cement vapor to non-toxic combustion products.

2. A method of producing a hot asphaltic material according to claim 1 wherein the step o±cooling comprises:

adding a second aggregate material at a third temperature lower than the first elevated temperature to at least a portion of the first aggregate material; and mixing said portion of said first aggregate material with said second aggregate material, such mixing raising the average temperature of said second aggregate material and cooling said portion of said first aggregate material on an average.

3. A method of producing a hot asphaltic material according to claim 2, wherein the second aggregate material is recycled asphaltic pavement and contains moisture, and the step of mixing said portion of said first aggregate material with said second aggregate material comprises:

heating the recycled asphaltic pavement to a temperature above the boiling temperature of water, thereby removing such moisture from said recycled asphaltic pavement; and removing thermal energy from said portion of said first aggregate material for removing such moisture from said recycled material and for heating said recycled material.

4. A method of producing a hot asphaltic material according to claim 1, wherein cooling at least a portion of the first aggregate material comprises:

transferring said first aggregate material into a pugmill; and mixing said first aggregate material in said pugmill with a second aggregate material at a third temperature lower than said first elevated temperature, such that said first aggregate material on an average is cooled to said second temperature lower than said first elevated temperature.

5. A method of producing a hot asphaltic material according to claim 4 wherein the second aggregate material is recycled asphaltic pavement and contains moisture, and the step of mixing said first aggregate material in said pugmill comprises:

heating the recycled asphaltic pavement to a temperature above the boiling temperature of water, thereby removing such moisture from said recycled asphaltic pavement; and removing thermal energy from said portion of said first aggregate material for removing such moisture from said recycled material and for heating said recycled material.

6. A method of producing a hot asphaltic material according to claim 1, wherein the first aggregate material is heated in a drum drier having a feed port at one longitudinal end and a discharge end at a second longitudinal end, the drum drier being longitudinally mounted to an elongate frame, wherein said portion of the first aggregate is cooled in a first region of a pugmill mounted to said frame adjacent a discharge end of the drum drier, wherein said portion of the first aggregate material is combined with an asphaltic cement in a second region of said pugmill, said second region being separated from said first region of the pugmill and including a discharge chute at an end removed from said first region, the method further comprising:

raising a portion of the frame adjacent the feed port of the drum drier with respect to the remainder of said frame, thereby increasing a flow-through capacity of said drum drier for said first aggregate material and simultaneously therewith increasing a discharge rate of material from said discharge chute of the pugmill.

7. A method of producing a hot asphaltic material according to claim 6, wherein a feed and transfer chute, located at the discharge end of the drum drier for transferring said first aggregate material to said first region of the pugmill includes a side discharge chute, the method further comprising:

removing at least a portion of said heated first aggregate material through said side discharge chute thereby preventing such removed portion from transfer to said pugmill; and directing a remaining portion of said first aggregate to said pugmill to be cooled therein.

* * * * *

UNITED STATES PATENT AND TRADEMARK OFFICE

CERTIFICATE OF CORRECTION

PATENT NO. : 5,002,398

DATED : March 26, 1991

INVENTOR(S) : Joseph E. Musil

It is certified that error appears in the above-identified patent and that said Letters Patent is hereby corrected as shown below:

In Column 1, Line 50 change "(he", to --the--.

In Column 6, Line 6 change "±rom", to --from--.

In Column 11, Line 44 change "the S", to --the--.

In Column 12, Line 36 change "o±" to --of--.

Signed and Sealed this

Fourth Day of August, 1992

*Attest:*

DOUGLAS B. COMER

*Attesting Officer*

*Acting Commissioner of Patents and Trademarks*